United States Patent [19]

Draxelmayr

[11] Patent Number: 4,656,415

[45] Date of Patent: Apr. 7, 1987

[54] CIRCUIT FOR GENERATING A REFERENCE VOLTAGE WHICH IS INDEPENDENT OF TEMPERATURE AND SUPPLY VOLTAGE

[75] Inventor: Dieter Draxelmayr, Villach, Austria

[73] Assignee: Siemens Aktiengesellschaft, Berlin and Munich, Fed. Rep. of Germany

[21] Appl. No.: 725,010

[22] Filed: Apr. 18, 1985

[30] Foreign Application Priority Data

Apr. 19, 1984 [DE] Fed. Rep. of Germany ..... 3415010

[51] Int. Cl.[4] ..... G05F 3/30

[52] U.S. Cl. ..... 323/314; 323/303; 323/907

[58] Field of Search ..... 323/223, 226, 299, 303, 323/313, 314, 907

[56] References Cited

U.S. PATENT DOCUMENTS

| | | | |
|---|---|---|---|
| 4,249,122 | 2/1981 | Widlar | 323/313 |
| 4,472,675 | 9/1984 | Shinomiya | 323/314 |
| 4,553,083 | 11/1985 | Yang | 323/299 |

FOREIGN PATENT DOCUMENTS

| | | | |
|---|---|---|---|
| 3137451 | 3/1983 | Fed. Rep. of Germany | 323/299 |
| 83/00756 | 3/1983 | World Int. Prop. O. | 323/313 |

OTHER PUBLICATIONS

Book, Entitled "Halbleiter-Schaltungstechnik", (Semiconductor-Circuit Technique) by U. Tietze and Ch. Schenk, 5th Revised Edition, Springer Verlag, Berlin, Heidelbert, New York 1980, p. 387 ff, p. 1 of Instant Application.

Article in "IEEE Journal of Solid-State Circuits", vol. SC 15, No. 6, Dec. 1980, pp. 1033 and 1039, p. 1 of Instant Application.

*Primary Examiner*—William H. Beha, Jr.

*Attorney, Agent, or Firm*—Herbert L. Lerner; Laurence A. Greenberg

[57] ABSTRACT

A circuit for generating a reference voltage which is independent of temperature and supply voltage includes a bandgap stage supplying the reference voltage, a first circuit receiving the supply voltage and generating an output voltage being substantially free of variations in the supply voltage, and a second circuit connected to the first circuit and driven by the output voltage, the second circuit being connected to the bandgap stage for supplying a current to the bandgap stage having a characteristic for compensating and eliminating temperature dependencies in the bandgap stage.

13 Claims, 4 Drawing Figures

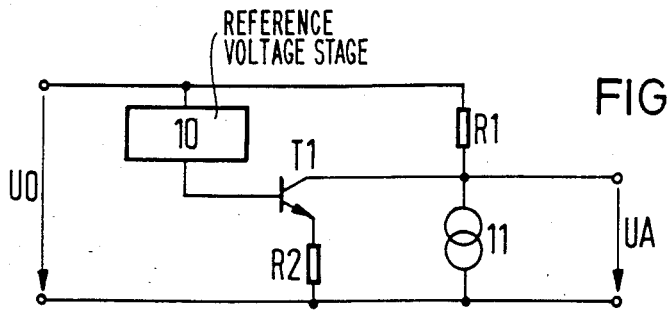
FIG 1
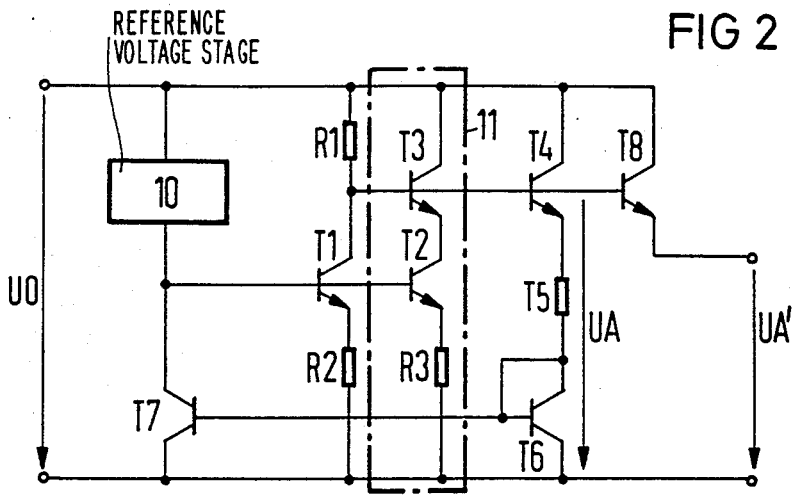
FIG 2
FIG 3
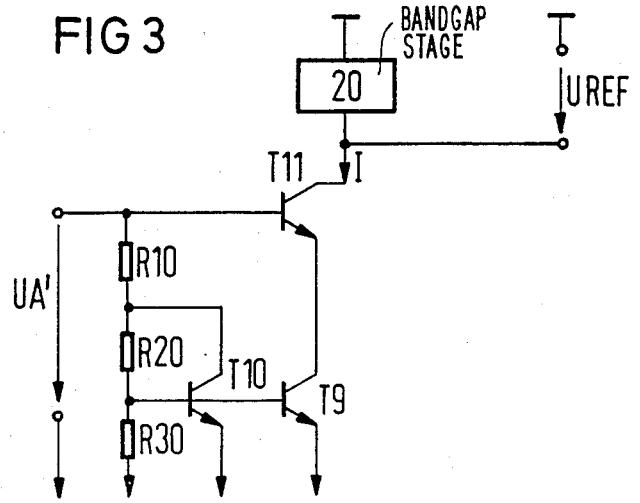

CIRCUIT FOR GENERATING A REFERENCE VOLTAGE WHICH IS INDEPENDENT OF TEMPERATURE AND SUPPLY VOLTAGE

The invention relates to a circuit for generating a reference voltage which is independent of temperature and supply voltage, including a bandgap stage supplying the reference voltage, to which a current for compensating still existing temperature dependencies having a characteristic eliminating these temperature dependencies, is fed.

Bandgap stages and bandgap circuits are conventional and are described, for instance, in the book entitled "Halbleiter-Schaltungstechnik" (Semiconductor-Circuit Technique) by U. Tietze and Ch. Schenk, 5th revised edition, Springer Verlag, Berlin, Heidelberg, New York 1980, Pages 387 ff.

In the above-mentioned publication, it is explained that by means of such bandgap circuits, reference voltages can be generated which are independent of the temperature coefficients of the components used therein. In other words, such a circuit supplies a temperature independent reference voltage. However, these considerations are only valid for first-order temperature dependencies in a relatively narrow temperature range. In practice, a voltage-temperature curve is only straight or independent of temperature in a narrow temperature range. Actually, such circuits still have a temperature dependency, which may have a parabolic shape with a change of about 1% in a temperature range from −55° C. to +125° C., according to an article in "IEEE Journal of Solid-State Circuits", Vol. SC 15, No. 6, Dec. 1980, Pages 1033 to 1039.

For certain applications, such as in fast digital-analog converters or analog-digital converters, the above-mentioned temperature dependency may still have a disturbing effect due to higher order temperature effects, so that the reference voltage generated by the bandgap circuit is not sufficiently independent of temperature. Measures for the temperature compensation of temperature dependencies of higher order, particularly second order, have already become known, for instance, from U.S. Pat. No. 4,249,122 and from the above-mentioned journal "IEEE Journal of State-Solid Circuits". In principle, these are circuitry measures, through which a current is fed to a bandgap circuit, the current having a temperature dependency compensating the temperature dependency of the bandgap circuit.

However, the object of such circuits is not only to compensate the temperature dependency as far as possible or completely, but also to take into consideration the fact that the supply voltage for the circuits also has fluctuations which must also be leveled out if highly constant reference voltages are to be generated. Therefore, if the temperature control circuit in particular is supplied with a supply voltage which has fluctuations, the requirements as to the constancy of the reference voltage are not yet satisfactorily met. If the supply voltage fluctuations as well as temperature changes are simultaneously leveled out in a single circuit or a single network, the control mechanism must be very accurate because these control mechanisms influence each other mutually.

It is accordingly an object of the invention to provide a circuit for generating a reference voltage which is independent of temperature and supply voltage, which overcomes the hereinafore-mentioned disadvantages of the heretofore-known devices of this general type, in which the leveling out of the two above-mentioned effects is ensured, and in which the leveling out of supply voltage fluctuations on the one hand, and the leveling out of temperature effects on the other hand, are decoupled from each other over a wide temperature range.

With the foregoing and other objects in view, there is provided, in accordance with the invention, a circuit for generating a reference voltage which is independent of temperature and supply voltage, comprising a bandgap stage supplying the reference voltage, a first circuit receiving the supply voltage and generating an output voltage being substantially free only of variations in the supply voltage, and a second circuit connected to the first circuit and driven by the output voltage, the second circuit being connected to the bandgap stage for supplying a current to the bandgap stage having a characteristic for compensating and eliminating still existing temperature dependencies in the bandgap stage. The circuit according to the invention has the advantage that, when leveling out supply voltage fluctuations in a circuit, only these particular supply voltage fluctuations need be taken into account, without having to consider pre-existing aspects of the temperature dependency of such a voltage which is free of fluctuations. The circuit for generating an output voltage which is substantially free, only of fluctuations in the supply voltage, may therefore still have a temperature dependency, if this output voltage is used as the input voltage for the circuit leveling out the temperature dependencies. In effect, the circuit which supplies the current that serves for compensating still existing temperature dependencies of the bandgap stage, then simultaneously assures the leveling out of the temperature dependencies which are still contained in the output voltage of the circuit regulating the supply voltage.

In accordance with another feature of the invention, the first circuit includes: a reference voltage stage for supplying another reference voltage: a transistor-inverter stage connected to the reference voltage stage and driven by the reference voltage, the transistor-inverter stage having a gain of 1 and a base current; and a compensating stage connected to the transistor-inverter stage for compensating the base current.

In accordance with a further feature of the invention, the transistor-inverter stage is in the form of a transistor being operated in an emitter circuit and having a base-emitter voltage, a resistor connected to the collector of the transistor, and a resistor connected to the emitter of the transistor, both being trimmed for compensating current-dependent changes in the base-emitter voltage of the transistor for maintaining the gain.

In accordance with an added feature of the invention, the transistorinverter stage provides an output signal, and the compensating stage is formed of two transistors having output circuits interconnected in series, one of the transistors being driven by the output signal of the transistor-inverter stage and the other of the two transistors being driven by the other reference voltage, and a resistor connected to the emitter of the other of the two transistors.

In accordance with an additional feature of the invention, there is provided a current source, the reference voltage stage including at least one other bandgap stage fed by the current source.

In accordance with again another feature of the invention, the current source is a current mirror.

In accordance with again a further feature if the invention,the transistor-inverter stage provides an output voltage addressing the current mirror.

In accordance with again an added feature of the invention, there is provided an emitter follower following the first circuit.

In accordance with again an additional feature of the invention, there is provided at least one additional circuit for generating the output voltage being substantially free of variations or fluctuations in the supply voltage, the at least one additional circuit being connected to the first circuit in a cascade.

In accordance with yet another feature of the invention, the second circuit includes a voltage divider receiving the output voltage of the first circuit and having a tap, and a current source transistor connected between the tap of the voltage divider and the bandgap stage for feeding the compensating end eliminating current for still existing temperature dependencies to the bandgap stage.

In accordance with yet a further feature of the invention, there is provided a transistor connected parallel to at least part of the voltage divider forming a voltage source together with the at least part of the voltage divider, and forming a current mirror together with the current source transistor.

In accordance with yet an added feature of the invention, there is provided another transistor driven by the output voltage of the first circuit and connected in series with the current source transistor.

In accordance with a concomitant feature of the invention, there is provided at least one additional circuit for supplying the compensating and eliminating current for temperature dependencies to the bandgap stage, the at least one additional circuit being connected in parallel with the second circuit.

Other features which are considered as characteristis for the invention are set forth in the appended claims.

Although the invention is illustrated and described herein as embodied in a circuit for generating a reference voltage which is independent of temperature and supply voltage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a schematic circuit diagram of a circuit for generating an output voltage, which is only free of fluctuations in the supply voltage;

FIG. 2 is a circuit diagram of an actual embodiment of the circuit according to FIG. 1;

FIG. 3 is a circuit diagram of a circuit driven by the output voltage of a circuit according to FIGS. 1 or 2, for generating a current which can be fed into a bandgap stage, and which serves for compensating temperature dependencies of the bandgap circuit.

Figure 4:
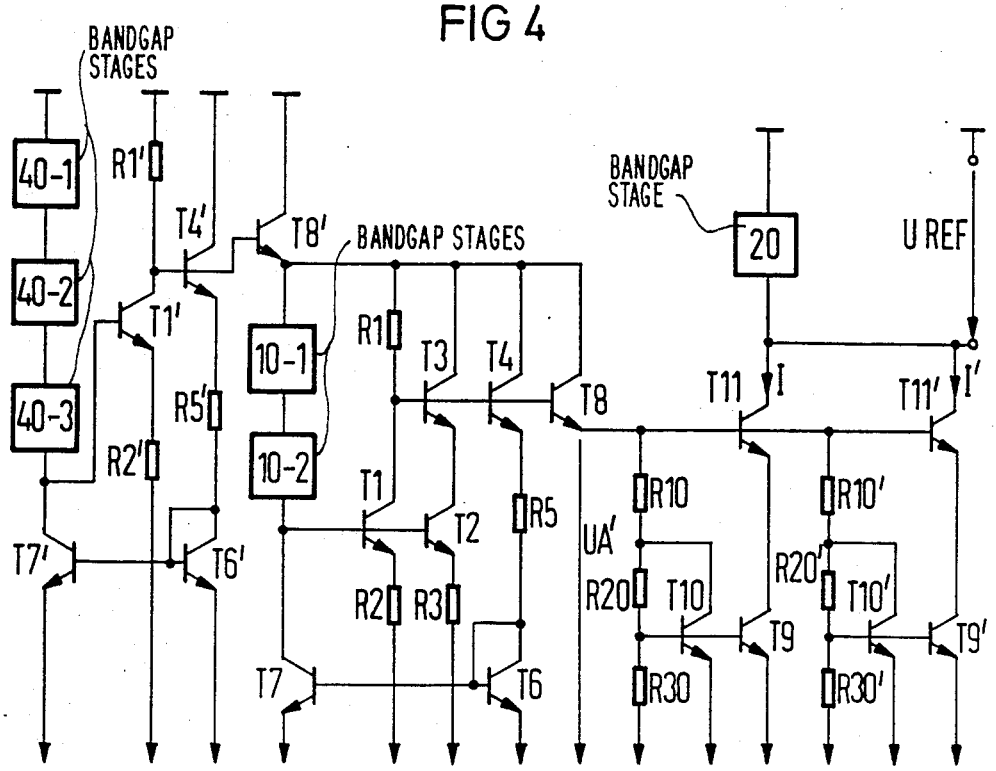
FIG. 4 is an overall circuit diagram of a practical embodiment of a circuit according to the invention.

Referring now to the figures of the drawings in detail and first particularly to FIG. 1 thereof, it is seen that a supply voltage U 0 which has fluctuations, is fed into a circuit for generating an output voltage UA which is only free of fluctuations in the supply voltage. A reference voltage is generated from the supply voltage U 0 by a reference voltage stage 10, which will be explained in greater detail below. The reference voltage stage 10 is followed by a transistor-inverter stage which is formed by a transistor T 1 operated in an emitter circuit with a resistor R 1 in the collector branch and a resistor R 2 in the emitter branch of the transistor.

The inverter stage has a gain of approximately 1, as far as its absolute value is concerned, if the resistors R 1 and R 2 have the same resistance value. However, the base current of transistor T 1 which flows through the resistor R 2 is not taken into consideration. For this reason, the inverter stage is followed by a stage which serves for compensating the base current of the transistor T 1. In the circuit according to FIG. 1, this compensating stage is generally provided by a current source. The compensating stage considers the difference between the currents flowing through the resistors R 1 and R 2 due to the base current of the transistor T 1, i.e. the current source 11 furnishes a current component causing the currents flowing through the resistors R 1 and R 2 to be equal. In order to account for the fact that the base-emitter voltage of the transistor T 1 still changes with the supply voltage U 0, the resistance values of the resistors R 1 and R 2 are chosen differently, in such a manner that the gain of the transistor-inverter stage R 1, T 1, R 2 remains equal to 1 as far as its absolute magnitude is concerned. In other words, this means that current dependent changes in the base-emitter voltage of the transistor T 1 are compensated by trimming the collector resistor R 1 and the emitter resistor R 2 in order to maintain the gain at the absolute value of 1. In this way, an output voltage U A which is independent of fluctuations in the supply voltage U 0 is obtained.

FIG. 2 shows a more detailed embodiment of the circuit according to FIG. 1, with elements that are the same as in FIG. 1 being provided with the same reference symbols.

The stage for compensating the base current of the transistor T 1 of the inverter stage R 1, T 1, R 2, is formed of two transistors T 3, T 2 which are interconnected in series at their output circuits. The transistor T 3 is driven by the output signal of the inverter stage R 1, T 1, R 2 and the transistor T 2 is driven by the reference voltage of the reference voltage stage 10. A resistor R 3 is connected into the emitter branch of the transistor T 2 which is driven by the reference voltage. The compensating stage serves for compensating the base current of the transistor T 1, since the influence of this base current is compensated by the base current of the transistor T 3 which has approximately the same magnitude. The stage 10 for generating the reference voltage is preferably a bandgap stage which is fed by a current source. The current source can be formed by a current mirror which is formed by a series circuit of a transistor T 4, a resistor T 5, a transistor T 6 which is connected as a diode, as well as a transistor T 7. The current mirror is driven by the output voltage of the inverter stage R 1, T 1, R 2. Specifically, the transistor T 4 is driven by the output signal of the inverter stage.

The circuit according to FIG. 2 therefore furnishes an output voltage U A at its output, i.e. at the base of the transistor T 4. However, the output voltage still exhibits a temperature drift. The output of the circuit, i.e. the transistor T 4, is followed by an emitter follower T 8, in order to take different loads of the circuit according to FIG. 2 into consideration. The base of the emitter follower T 8 is connected to the base of the transistor T 4. The emitter follower T 8 operates as a decoupling impedance transformer, from which an output voltage U A' can be taken.

According to FIG. 3, the output voltage U A' of the circuit for generating an output voltage which is free of fluctuations in the supply voltage, is fed to a circuit which furnishes a current I for the compensation of still existing temperature dependencies of a bandgap stage 20. Specifically, the circuit for producing the current I contains a voltage divider at the input thereof which is formed of resistors R 10, R20, R 30. However, this voltage divider need not necessarily be formed of resistors alone. On the contrary, embodiments may be provided in which at least one of the resistors in the voltage divider is replaced by a diode.

In the embodiment according to FIG. 3, a current source transistor T 9 is connected between the resistors R 20 and R 30, which furnishes the current that compensates for the temperature dependencies of the bandgap stage 20.

According to a special embodiment of the invention, a voltage source can be formed by at least part of the voltage divider and a transistor T 10 connected parallel thereto, the last mentioned transistor forming a current mirror with the current source transistor T 9. In the embodiment under discussion, the voltage source is formed by the resistors R 20 and R 30 of the voltage divider along with the transistor T 10. The transistor T 10 is connected with its collector-emitter path parallel to the resistors R 20, R 30, and the base thereof connected to the tap between the resistors R 20 and R 30.

In order to compensate the so-called "Early Effect", a transistor T 11 driven by the output voltage U A', which is free of supply voltage fluctuations, can be connected in series with the current source transistor T 9.

Since the temperature drift of the voltage U A' is known, a desired temperature drift of the current I flowing into the bandgap stage 20 can be set-in, by choosing the resistance values of the resistors R 10, R 20, R 30 in the voltage divider. In this way, higher-order temperature variations, to which the bandgap stage 20 is still subjected in line with the explanations given above, are compensated. The output voltage, represented by a reference voltage U Ref of the bandgap stage 20, is therefore free of fluctuations in the supply voltage and is also free of temperature variations.

FIG. 4 shows a practical embodiment of a circuit according to the invention, in which elements that are the same as in the circuits according to FIGS. 1 to 3 are provided with the same reference symbols. In order to avoid repetition, reference is made to the components of the circuits according to FIGS. 1 to 3 in order to explain the components in FIG. 4 provided with the same reference symbols. In the practical embodiment of the circuit according to FIG. 4, the reference voltage stage 10 according to FIGS. 1 and 2 is formed by two series-connected bandgap stages 10-1 and 10-2. However, it is not absolutely necessary to use bandgap stages for providing the reference voltage stage. For instance, diodes can also be provided in this reference voltage stage.

In the device according to to FIG. 4, two circuits for generating the output voltage U A' which is free of variations in the supply voltage are provided. The first circuit is formed by a circuit corresponding to the circuit according to FIG. 2, and is followed by a circuit according to FIG. 2 in a cascade. In order to indicate that this first circuit, which causes a prestabilization of the supply voltage, corresponds to the circuit according to FIG. 2, the reference symbols of corresponding elements are provided with a prime. In the first circuit, the stage furnishing the reference voltage is formed by three series-connected bandgap stages 40-1 to 40-3, and it must again be pointed out that bandgap stages need not be used necessarily. As in the case of the reference voltage stage formed by the stages 10-1 and 10-2, the stages 40-1 to 40-3 can also be formed by a diode chain, for instance.

Greater variability of the temperature compensation is achieved by adding a further circuit for generating a current which compensates temperature dependencies for the bandgap stage 20. Different values can be chosen for the components provided in the further circuit. In order to indicate that this further circuit corresponds to the circuit according to FIG. 3, the appropriate reference symbols are again provided with a prime. As can be seen from FIG. 4, the two circuits supplying a current for the compensation of temperature dependencies, are interconnected in parallel.

The foregoing is a description corresponding in substance to German application Ser. No. P 34 15 010.2, filed Apr. 19, 1984, the International priority of which is being claimed for the instant application, and which is hereby made part of this application. Any material discrepancies between the foregoing specification and the aforementioned corresponding German application are to be resolved in favor of the latter.

I claim:

1. Circuit for generating a reference voltage which is independent of temperature and supply voltage, comprising a bandgap stage supplying the reference voltage, a first circuit receiving the supply voltage and generating an output voltage being substantially free of variations in the supply voltage, and a second circuit connected to said first circuit and driven by said output voltage, said second circuit being connected to said bandgap stage for supplying a current to said bandgap stage having a characteristic for compensating and eliminating temperature dependencies in said bandgap stage.

2. Circuit for generating a reference voltage which is independent of temperature and supply voltage, comprising a bandgap stage supplying the reference voltage, a first circuit receiving the supply voltage and generating an output voltage being substantially free of variations in the supply voltage, and a second circuit connected to said first circuit and driven by said output voltage, said second circuit being connected to said bandgap stage for supplying a current to said bandgap stage having a characteristic for compensating and eliminating temperature dependencies in said bandgap stage, wherein said first circuit includes: a reference voltage stage for supplying another reference voltage; a transistor-inverter stage connected to said reference voltage, said transistor-inverter stage having a gain of 1 and a base current; and a compensating stage connected to said transistor-inverter stage for compensating said base current.

3. Circuit according to claim 2, wherein said transistor-inverter stage is in the form of a transistor being operated in an emitter circuit and having a base-emitter voltage, a resistor connected to the collector of said transistor, and a resistor connected to the emitter of said transistor, said resistors being trimmed for compensating current-dependent changes in the base-emitter voltage of the transistor for maintaining the gain.

4. Circuit according to claim 2, wherein said transistor-inverter stage provides an output signal, and said compensating stage is formed of two transistors having output circuits interconnected in series, one of said two transistors being driven by said output signal of said transistor-inverter stage and the other of said two transistors being driven by said other reference voltage, and a resistor connected to the emitter of the other of said two transistors.

5. Circuit according to claim 2, including a current source, said reference voltage stage including at least one other bandgap stage fed by said current source.

6. Circuit according to claim 5, wherein said current source is a current mirror.

7. Circuit according to claim 6, wherein said transistor-inverter stage provides an output voltage addressing said current mirror.

8. Circuit according to claim 1, including an emitter follower connected to said first circuit.

9. Circuit according to claim 1, including at least one additional circuit for generating said output voltage being substantially free of variations in the supply voltage, said at least one additional circuit being connected to said first circuit in a cascade.

10. Circuit for generating a reference voltage which is independent of temperature and supply voltage, comprising a bandgap stage supplying the reference voltage, a first circuit receiving the supply voltage and generating an output voltage being substantially free of variations in the supply voltage, and a second circuit connected to said first circuit and driven by said output voltage, said second circuit being connected to said bandgap stage for supplying a current to said bandgap stage having a characteristic for compensating and eliminating temperature dependencies in said bandgap stage, wherein said second circuit includes a voltage divder receiving said output voltage of said first circuit and having a tap, and a current source transistor connected between said tap of said voltage divider and said bandgap stage for feeding said compensating and eliminating current for temperature dependencies to said bandgap stage.

11. Circuit according to claim 10, including a transistor connected parallel to at least part of said voltage divider forming a voltage source together with said at least part of said voltage divider, and forming a current mirror together with said current source transistor.

12. Circuit according to claim 11, including another transistor driven by said output voltage of said first circuit and connected in series with said current source transistor.

13. Circuit according to claim 1, including at least one additional circuit for supplying said compensating and eliminating current for temperature dependencies to said bandgap stage, said at least one additional circuit being connected in parallel with said second circuit.

* * * * *